US005549449A

United States Patent [19]

McInerney et al.

[11] Patent Number: 5,549,449

[45] Date of Patent: Aug. 27, 1996

[54] TURBOMACHINERY INCORPORATING HEAT TRANSFER REDUCTION FEATURES

[75] Inventors: William L. McInerney, Dallas; Norbert L. Osborn; Gerhard M. Schruf, both of Irving, Tex.

[73] Assignee: WRR Industries, Inc., Dallas, Tex.

[21] Appl. No.: 86,924

[22] Filed: Jul. 2, 1993

[51] Int. Cl.[6] ..... F04D 29/58

[52] U.S. Cl. ..... 415/177; 415/200; 415/214.1; 417/406; 384/413; 384/473

[58] Field of Search ..... 415/177, 178, 415/200, 214.1; 417/406; 384/413, 408, 409, 400, 469, 473; 285/365, 367, 407; 24/20 R, 279 R; 29/889.2; 184/6.2, 64

[56] References Cited

U.S. PATENT DOCUMENTS

| | | | |
|---|---|---|---|
| 2,837,383 | 6/1958 | Skelly | 285/367 |
| 3,013,821 | 12/1961 | Bogan | 285/407 |
| 3,099,060 | 7/1963 | Smith | 285/367 |
| 3,106,381 | 10/1963 | Leins | 415/177 |
| 4,101,241 | 7/1978 | Kasuya | 415/178 |
| 4,101,243 | 7/1978 | Tatkov et al. | 285/367 |
| 4,179,247 | 12/1979 | Osborn | 417/406 |
| 4,353,685 | 10/1982 | Osborn | 417/406 |
| 4,430,011 | 2/1984 | Kun | 394/99 |
| 4,490,622 | 12/1984 | Osborn | 417/406 |
| 4,521,155 | 6/1985 | Osborn | 417/406 |
| 4,919,453 | 4/1990 | Halling et al. | 285/367 |
| 4,932,207 | 6/1990 | Harris et al. | 60/39.36 |
| 5,070,708 | 12/1991 | Malosh et al. | 62/295 |
| 5,087,176 | 2/1992 | Wieland | 415/178 |
| 5,125,228 | 6/1992 | Jewess et al. | 60/39.36 |
| 5,161,945 | 11/1992 | Clevenger et al. | 415/177 |
| 5,233,824 | 8/1993 | Clevenger | 415/178 |
| 5,249,934 | 10/1993 | Merritt et al. | 417/406 |
| 5,261,145 | 11/1993 | Jennings | 24/20 R |

OTHER PUBLICATIONS

"Kany–Bus Mit Turbo auf 90PS" GUTE FAHRT, p. 46 (Jan. 1993).

*Primary Examiner*—Edward K. Look
*Assistant Examiner*—Michael S. Lee
*Attorney, Agent, or Firm*—Richards, Medlock & Andrews

[57] ABSTRACT

A turbocharger includes a turbine and compressor housing attached by a circumferential clamp with circumferentially staggered contact points between the clamp and the housings to reduce heat transfer from the turbine housing to the compressor housing. The mass of the turbine housing is reduced and the mass of the compressor housing is increased to reduce the transfer of heat from the turbine housing to the compressor housing from the thermal flux of the turbine side heat energy. The compressor housing mass is increased by incorporating a heat-transfer interface between the compressor housing and the oil reservoir cover, which oil reservoir extends circumferentially around the axis of the turbocharger rotor shaft. Concentricity between the components of the turbocharger is achieved by creating the radial junction between the turbine and compressor backwalls on the smallest feasible diameter to minimize the effects of thermally induced distortion on component concentricity. The compressor side backwall is fitted with an insert having a mean coefficient of thermal expansion equal to or greater than the average of the mean coefficient of thermal expansion of the turbine and compressor backwalls to maintain proper concentricity between the turbine housing and the compressor housing even though such housings are formed of different materials having different coefficients of thermal conductivity and thermal expansion.

6 Claims, 5 Drawing Sheets

TURBOMACHINERY INCORPORATING HEAT TRANSFER REDUCTION FEATURES

TECHNICAL FIELD OF THE INVENTION

The present invention relates to turbomachinery and more particularly to turbomachinery with variable turbine inlet and fixed turbine inlet designs incorporating heat transfer reduction features.

BACKGROUND OF THE INVENTION

Turbomachinery, such as turbochargers, have been used as a means of greatly extending the power range and flexibility of internal combustion engines. These devices use engine exhaust to drive a turbine which in turn drives a compressor for supplying a compressed air charge to the engine. In most configurations, the turbine and compressor rotors rotate on a rotor shaft supported on bearings, such as journal, flat disc-type thrust bearings or ball bearings. Although the use of ball bearings improve the turbomachinery operation and efficiency, because of the proximity of the bearings to the hot exhaust gases used to drive the turbine rotor, they are susceptible to damage and are more vulnerable to the problems caused by overheating than journal bearings or flat disc-type thrust bearings.

One design incorporating ball bearings is shown in U.S. Pat. No. 4,179,247, to Osborn. In this design, the bearing assemblies are separated from the turbine and thus are spaced from the intense heat to which the turbine is subjected. The compressor rotor and turbine rotor are located in an overhung position with the compressor rotor positioned between the turbine rotor and the bearings. Further, control structure for controlling the turbine inlet nozzle area is positioned between the turbine side of the turbocharger and the compressor side to insulate the bearings from the turbine exhaust gases.

Because of the criticality of precision ball bearings used in turbomachinery, including turbochargers, bearing life can be extended, and the overall longevity of the turbocharger increased by further reducing heat which may be transferred from the turbine side of the turbomachinery to the bearings. Thus, although the design shown in U.S. Pat. No. 4,179,247 reduces the amount of heat ultimately transferred to the bearings, a need exists for further isolating the bearings to reduce the transfer of heat thereto and for a means for preventing lubricant used for the bearings from reaching elevated temperatures.

Further, it has been demonstrated that providing a separate reservoir of oil for lubrication of the bearings of turbomachinery, rather than use of the oil in the internal combustion engine on which the turbomachinery is mounted, greatly enhances the life of the turbocharger. However, providing such a reservoir as a part of the turbomachinery housing limits the application of prior designs to certain engines because of the restriction on the orientation of the turbocharger for purposes of assuring proper oil delivery to the bearings. Thus, a need exists for a design which permits unlimited orientation of the turbomachinery relative to the engine on which it is mounted.

For proper operation, turbomachinery must function within and maintain very close tolerances between the turbine and compressor rotors and the surrounding housing. This requires that the compressor housing and turbine housing maintain proper concentricity with respect to the compressor and turbine rotors and therefore with respect to each other. Achieving this result is difficult in that such housings are formed of different materials having different coefficients of thermal expansion. Thus, a need exists for a way to maintain concentricity between components.

SUMMARY OF THE INVENTION

The present invention provides improvements to turbomachinery, and in particular to turbochargers used on internal combustion engines, which overcome many of the disadvantages heretofore experienced in turbomachinery.

In accordance with one aspect of the invention, a circumferential clamp is used to attach the compressor housing and the turbine housing to minimize the conductive heat transfer from the turbine housing to the compressor housing. The clamp is comprised of a band which at least partially encircles the turbine housing and compressor housing and engages both housings. The band has a first set of engagement surfaces for engaging the turbine housing and a second set of engagement surfaces for engaging the compressor housing. The first set of engagement surfaces are circumferentially staggered relative to the second set of surfaces. In one embodiment of the invention, the first set of engagement surfaces are staggered such that the projection of the areas of the first set of surfaces along axes parallel to the longitudinal axis of the turbocharger does not project on certain of the surfaces of the second set of engagement surfaces.

In a further embodiment of the invention, the clamp has an outer band with the engagement surfaces being on pads positioned at an incline from the outer band. Using a select number of engagement surfaces reduces the contact area between the clamp and the compressor and turbine housings thereby decreasing the heat transfer without compromising clamping strength or economy of manufacturing. The materials of the turbine housing and compressor housing are different, each having a different compressive yield strength. Knowing the axial clamping force of the clamp, the number and size of the engagement surfaces can be calculated. Further, by staggering the engagement surfaces along the circumference of the clamp, the path of heat flux can be lengthened thereby increasing the time required for heat to travel from the turbine side to the compressor side flanges. The number and size of engagement surfaces are designed based on the compressive yield strength of the material of the respective housings. An optimum ratio of turbine side to compressor side engagement areas can be derived which maximizes the heat flux path-length while avoiding localized stresses which approach the compressive yield strength of the respective flange material. Simultaneously, the design minimizes the total contact area between the clamp and the housing flanges thereby reducing the heat flux path.

The present invention also reduces the temperature rise of the compressor housing resulting from conduction and radiation from the turbine housing by mass redistribution of the components. Where the turbocharger is shut down in any high heat situation, a substantial amount of heat and energy must be dissipated from the turbine side. Radiant cooling to the atmosphere occurs at a maximum theoretical rate determined by ambient conditions, exterior surface area as well as other factors. A substantial amount of heat is transferred to the compressor side by conduction and radiation, where it is subsequently dissipated. Where thermal insulation has been optimized to minimize conduction of heat energy between the turbine and the compressor sides, further design to control the rate of heat transfer results in little practical effect. The thermal flux (amount of heat transferred between components in a given time) is limited by the thermal conductivity of the optimized insulation design and is, therefore, predictable. However, because the quantity of heat is a given in any hot shutdown situation, the ability of the turbine housing to store and dissipate that energy is a primary influence on the inevitable transfer of heat to the compressor side. While practical limitations on casting techniques, material costs and other design considerations govern the effective outside surface area that can dissipate heat from the turbine housing to the atmosphere, the effective heat content can be minimized by reducing the total mass of the turbine housing. Thus, the present invention takes advantage of this situation by carefully engineering thin wall sections with highly stressed bosses and flanges thereby appreciably reducing the capacity of the turbine housing to retain heat after a hot shutdown.

To further prevent temperature rise in the compressor side, the compressor side mass is increased. By increasing the mass of the compressor housing casting and its subcomponents, the resulting temperature increase from the thermal flux of the turbine side heat energy is minimized. Thus, in the present invention the turbine and compressor housings are designed such that the mass ratio of the turbine side to the compressor side is equal to or less than 2.0.

The effective mass of the compressor housing is increased by incorporating a heat-transfer interface in the oil reservoir cover design. The location, geometry and surface finish of axial and radial mating surfaces between the compressor housing and the oil reservoir cover assure that effective contact is maintained throughout and after a hot shutdown situation. This control of the heat flux path enhances dissipation of excess heat energy, further protecting the precise miniature bearings used in the turbocharger.

The use of a quantity of synthetic lubricant oil contained within the integral oil reservoir contributes to the total mass of the compressor section, further enhancing heat absorption capacity. The oil is in contact with surfaces of both the compressor housing and the reservoir cover and thus heat transfer between respective components is improved. Localized variances and surface temperature are reduced as well. Moreover, the mass of reservoir housing and quantity of lubrication oil augments that of the compressor housing and this increased mass on the compressor side improves the durability of the unit by reducing the peak thermal exposure experienced by the bearings.

In accordance with still another embodiment of the invention, the present turbocharger incorporates a circular oil reservoir having a chamber which extends circumferentially around the axis of the turbocharger rotor shaft. Wicks extend from the reservoir chamber to supply oil to the bearings. Because the oil reservoir extends circumferentially around the axis of the turbocharger, the turbocharger may be installed in any orientation relative to the turbocharger axis. Further, the oil reservoir chamber comprises a removable housing section that is releasably connected to the compressor housing. In one embodiment of the invention, this releasable connection to the compressor housing is accomplished by using elastomeric seals, such as O-rings. Not only do the O-rings form a leak-tight barrier between the compressor housing and the oil reservoir cover, such elastomeric seals also retain the reservoir cover in place thereby eliminating the need for mechanical fasteners. This is accomplished by positioning an outer elastomeric seal in a circumferential groove in the compressor housing and a circumferential groove in the oil reservoir housing.

By using an oil reservoir housing interface which is radially symmetrical with the compressor housing and mates directly with the compressor housing, the oil reservoir housing can be designed to accommodate different diameter air supply hoses or ducting as needed and can be positioned in any angular orientation relative to the compressor housing.

Maintaining concentricity between components is a necessity in the design and manufacture of turbomachinery. This is achieved in the present invention by creating the radial junction between the turbine and compressor backwalls on the smallest feasible diameter to minimize the effects of thermally induced distortion on component concentricity. With the use of a overhung rotor design wherein the compressor and turbine rotors are positioned to one side of the bearing assembly, this juncture is within a region of high temperature differences. Moreover, the use of differing materials in the turbine backwall and the compressor backwall introduces vastly different coefficients of thermal conductivity (K) and thermal expansion (CTE). Furthermore, this component interface must endure considerable mechanical loading, vibration-induced wear and exposure to corrosive exhaust gases.

The present design overcomes these difficulties by integrating an insert into the compressor side backwall designed to provide low thermal conductivity and durable surface-wear characteristics at the turbine-to-compressor interface. This is accomplished by using a specifically designed insert, having a mean coefficient of thermal expansion equal to or greater than the average of the mean coefficient of thermal expansion of the turbine and compressor backwalls. In the preferred embodiment, this coefficient of the insert is greater than the average of the coefficients of the turbine and compressor backwalls. This insert is then incorporated into the compressor backwall by being cast as an integral part thereof. This assures mechanical integrity. As such, the design results in better radial concentricity and improved surface-wear characteristics and resistance to hot, corrosive gases. By controlling concentricity, blade tip clearance can be reduced, to as small as 0.0065 in., resulting in greatly improved compressor and turbine efficiencies.

Therefore, in accordance with one embodiment of the invention, a turbocharger is designed to maintain proper concentricity between the turbine housing and the compressor housing even though such housings are formed of different materials having different coefficients of thermal conductivity and thermal expansion. The turbocharger includes a turbine housing and a compressor housing with the turbine housing formed of a first metal, such as cast iron, and the compressor housing formed of a different metal, such as aluminum. A turbine and compressor rotor are mounted on a shaft for rotation in the turbocharger housing. The turbine housing has a backwall positioned between the turbine rotor and the compressor rotor and is formed from the first metal. The compressor housing has a backwall between the turbine rotor and compressor rotor and is formed of the second metal. A metal insert is cast into the compressor backwall and is positioned for engagement with the turbine backwall for aligning the turbine housing relative to the compressor housing. The insert is formed of a material having a coefficient of thermal conductivity less than that of the turbine backwall and a coefficient of thermal expansion equal to or greater than (and preferentially greater than) the average of that of the turbine and compressor backwalls.

In a further embodiment of the invention, the insert has a dovetail protrusion along its radially outwardly directed face which is fully engaged on all sides by the compressor backwall. This is achieved by casting the compressor backwall around the insert.

In accordance with another embodiment of the invention, the alignment junction between the turbine housing and compressor housing is along a radial surface on the insert and the turbine backwall. This radial surface has a diameter which is as small as possible and is less than the diameter of the backwalls and of the compressor or turbine rotors.

BRIEF DESCRIPTION OF THE DRAWINGS

For a more complete understanding of the present invention, and for further details and advantages thereof, reference is now made to the following description taken in conjunction with the accompanying drawings, in which.

DETAILED DESCRIPTION OF THE PREFERRED EMBODIMENTS

Figure 1:
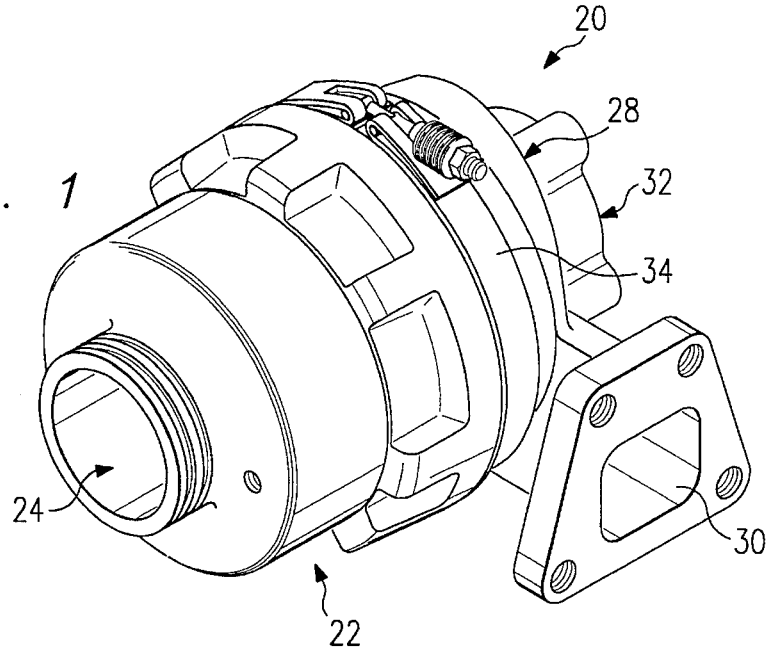
FIG. 1 is a perspective view of a turbocharger incorporating the present invention.

FIG. 1 is a perspective view of a turbocharger 20 embodying the present invention. The turbocharger includes a compressor side 22 having a compressor air inlet 24 and a compressor discharge 26 (shown in FIG. 3) formed therein. Turbocharger 20 also includes a turbine side 28 having a turbine inlet 30 and a turbine outlet 32. The compressor side 22 and a turbine side 28 are joined by a clamp 34. In operation of the turbocharger, air is drawn into inlet 24 and compressed air is discharged from compressor discharge 26 to an internal combustion engine on which the turbocharger is mounted. Exhaust from the engine is channeled into turbine inlet 30 to drive the turbocharger turbine and is exhausted through turbine outlet 32.

Figure 2:
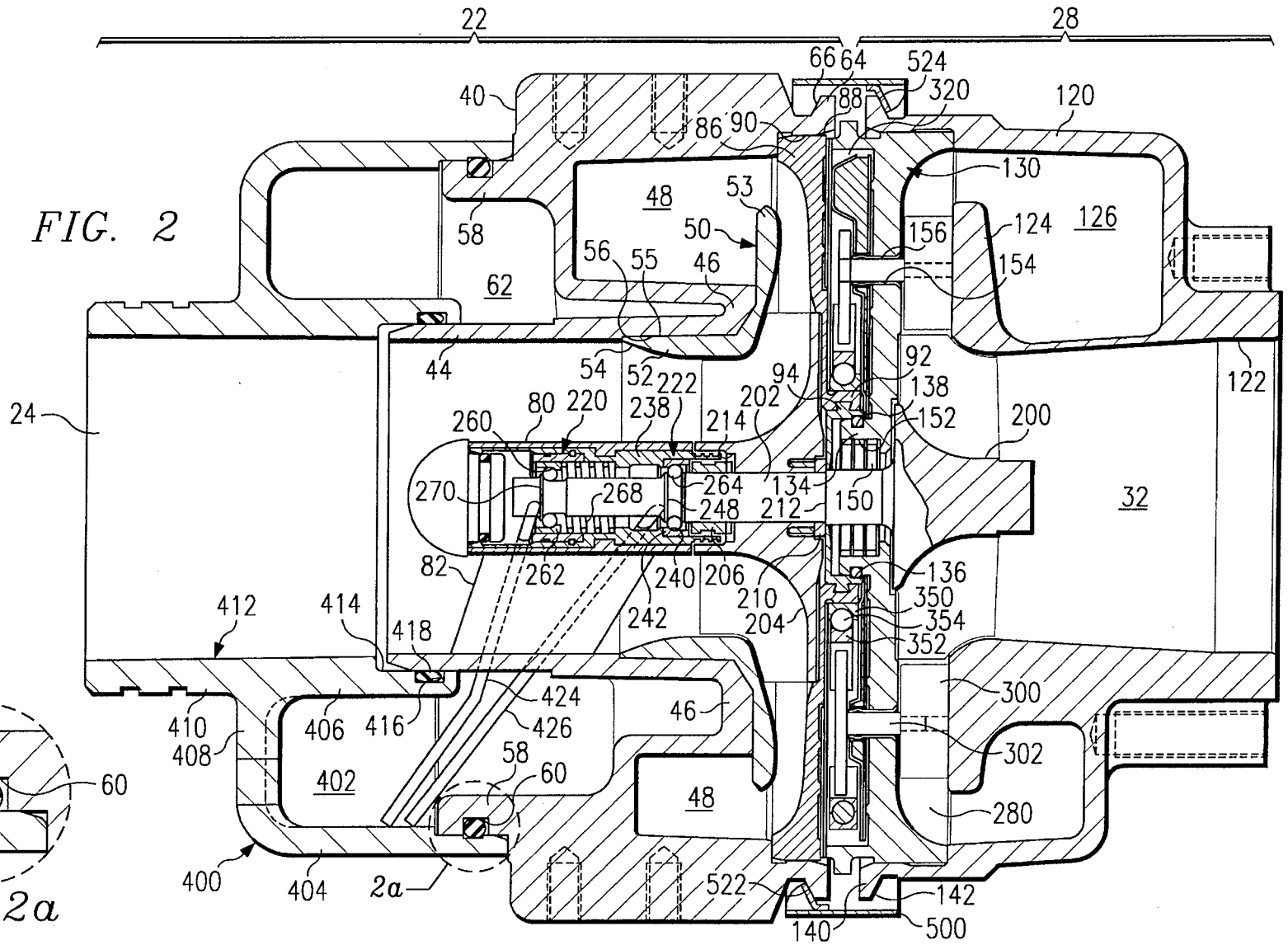
FIG. 2 is a vertical section view of the turbocharger illustrated in FIG. 1.
Figure 3:
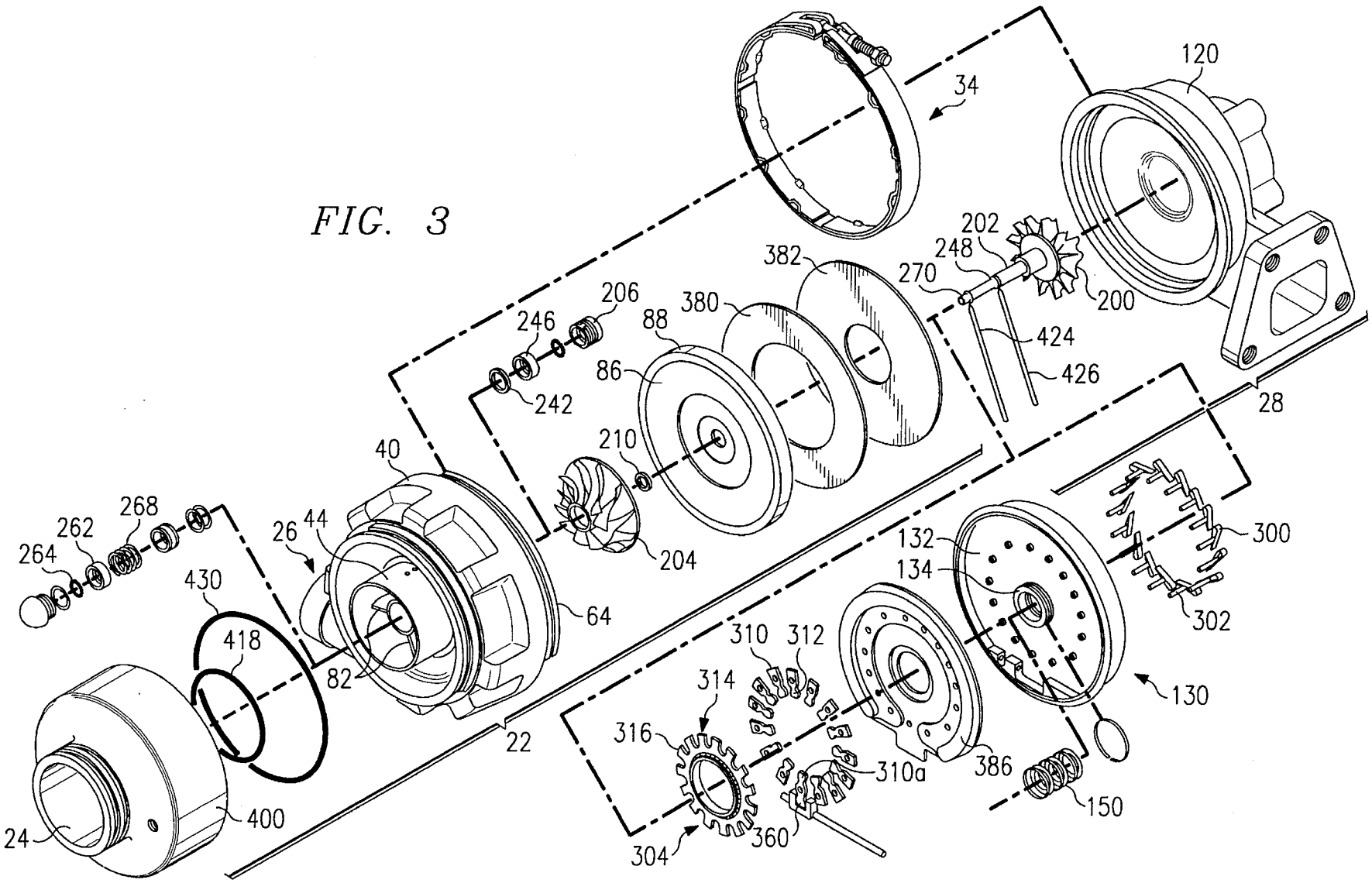
FIG. 3 is an exploded view of the turbocharger shown in FIG. 1.

Referring to FIGS. 2 and 3, compressor side 22 consists of a housing 40 having an inlet wall 44 with a transverse wall 46 formed integrally therewith. A circumferential chamber 48 is formed from wall 46 remote from the inlet wall 44 and has a varying area around its circumference increasing to the discharge provided by compressor exhaust 26 (FIG. 3). An oil reservoir extension sleeve 58 extends from housing 40 and has a circumferential groove 60 therein. A circumferential chamber 62 is formed between extension sleeve 58 and inlet wall 44.

An assembly flange 64 is formed on the opposite end of housing 40 and has an inclined surface 66 to facilitate assembly as will be described hereinafter. A forward compressor scroll insert 50 includes a tubular throat 52 and a circular disc 53 attached transversely to one end of throat 52. Throat 52 has an inside wall surface 54 that defines the area around the turbocharger compressor inlet and an outer surface 55 for mating with a corresponding surface 56 formed in the inside surface of inlet wall 44. Insert 50 is inserted within and mated with the inlet defined by inlet wall 44.

Referring still to FIGS. 2 and 3, a bearing support cylinder 80 is supported concentrically within inlet wall 44 by three equally spaced struts 82 extending inwardly from the wall 44. Bearing support cylinder 80 houses bearing assemblies, which will be described hereinafter in greater detail, for supporting the turbocharger compressor and rotor.

The compressor side 22 includes a compressor backwall 86 which is received within compressor housing 40. Compressor backwall 86 has an outwardly directed circumferential surface 88 that confronts a corresponding inwardly facing circumferential wall 90 formed in compressor housing 40. As is shown in greater detail in FIG. 6, compressor backwall 86 has a cylindrical extension 92 which encircles a metal insert 94. Metal insert 94 has a disc portion 96 and a sleeve portion 98 having a radially extending dovetail portion 100. Insert 94 has radial outwardly facing surfaces 106 and 108 which confront and are in surface to surface contact with radially inwardly facing surfaces 110 and 112, respectively, on backwell 86. Disc portion 96 has a bore therethrough for receiving the turbine and compressor shaft as will be described hereinafter in greater detail. Metal insert 94 has a annular groove 104 formed in its inwardly exposed face.

In accordance with one embodiment of the invention, compressor housing 40 and compressor scroll insert 50 are aluminum, preferably 384 (AISI) and compressor backwall 86 is aluminum, preferably 354 (AISI), although it will be understood that other suitable aluminum casting alloys may be used. In one embodiment, the backwall has a mean coefficient of thermal expansion of $$22.0\,\frac{m}{m^{\circ}K}$$

and a conductivity (K) value of $$168\,\frac{W}{m^{\circ}K}\,.$$

In contrast, metal insert 94 is stainless steel, preferably 304 (AISI), and has a coefficient of thermal expansion $$16\times10^{-6}\,\frac{m}{m^{\circ}K}$$

and a K value of $$14\,\frac{W}{m^{\circ}K}\,.$$

Referring to the turbine side 28 of the turbocharger, the turbocharger includes a turbine housing 120 with an exhaust port 122 leading to a forward turbine scroll 124 that defines a circumferential chamber 126 for receiving exhaust gases from inlet 30 (FIG. 1). On the face confronting the compressor side, turbine housing 120 has a flange 140 with an inclined wall 142 defined thereon. Turbine housing 120 receives a turbine backwall 130. Both turbine backwall 130 and turbine housing 120 are heat resistor alloy castings; however, it will be understood by those skilled in the art that various high temperature materials may be used. The turbine backwall has a coefficient of thermal expansion of $$2.8 \times 10^{-6} \frac{m}{m^{\circ}K}$$

and a K value of $$42 \frac{W}{m^{\circ}K}.$$

Thus, insert 94 has a coefficient of thermal conductivity less than that of both the compressor backwall and turbine backwall and acts as an insulator and also has a coefficient of thermal expansion greater than the average of that of the turbine and compressor backwalls.

Turbine backwall 130 has a disc portion 132 with a sleeve portion 134 extending therefrom. Sleeve portion has an external annular groove formed therein for receiving a seal ring 136. As can be seen in the section view of FIG. 2, sleeve portion 134 is received within metal insert 94 of the compressor backwall 86. Seal 136 is positioned such that, in the assembled position, it occupies the annular groove 138 in sleeve portion 134 of turbine backwall 130 and annular groove 104 of sleeve portion 98 of metal insert 94. As can be seen in FIGS. 2 and 3, a plurality of labyrinth seals 150 are positioned within bore 152 in turbine backwall 130.

A radial flow turbine rotor 200 is fixedly attached on one end of the rotor shaft 202, such as by welding. A compressor rotor 204 is mounted on shaft 202 using a press on retainer 206. Compressor rotor 204 is drilled to receive shaft 202 and counterbored to form bore 214. Bore 214 has a diameter larger than the outer diameter of retainer 206 such that the retainer may be pressed onto shaft 202 near engagement with the bottom wall of bore 214 to retain the compressor rotor in position on shaft 202. A compressor rotor shim 210 is positioned between compressor rotor 204 and a step 212 in shaft 202 to accurately position the compressor rotor in the axial direction. Compressor rotor 204 and turbine rotor 200 are supported in an overhung position to one side by ball bearing assemblies 220 and 222 housed within bearing support cylinder 80.

Bearing assemblies 220 and 222 and the mounting of the turbine and compressor rotors from shaft 202 relative to the bearing assemblies will be described with reference to FIG. 2. Bearing support cylinder 80 has an inner sleeve 238 fitted therein. An outer raceway 240 is formed in a raceway ring 242 positioned relative to sleeve 238. The bearing assembly 222 is made by positioning a full compliment of balls 246 in raceway 248 formed on shaft 202 and engaging raceway ring 242 therearound.

Referring to bearing assembly 220, an outer raceway 260 is formed in ring 262 with the ball radius on only side therein. Balls 264 are assembled by moving outer ring 262 to compress spring 268 and inserting a full compliment of balls in raceway 270 formed on shaft 202. As can be seen in FIG. 2, spring 268 acts between ring 262 and a step formed within sleeve 238.

In one embodiment of the invention, the turbocharger according to the present invention is of the type which incorporates variable turbine inlet area controls. Such controls are used to the selective change of the turbine nozzle area to control the speed or pressure output of the turbocharger. While the embodiment shown in FIGS. 1 through 3 incorporates structure for varying the turbine nozzle area, it will be understood that the structures described in the present invention may separately be applied to turbochargers which have a fixed turbine nozzle inlet area such as that shown in FIG. 7.

By selectively varying the turbine nozzle area, the turbocharger speed and pressure output can be controlled. Referring to FIGS. 1, 2 and 3, exhaust gas from the internal combustion engine on which the turbocharger is mounted is injected into the turbocharger through turbine inlet 30 and channeled against the blades of turbine rotor 200 through a nozzle area 280 formed by turbine backwall 130, forward turbine scroll 124 and a plurality of nozzle vanes 300. Turbine backwall 130 has a plurality of apertures 154 formed through disc portion 132. These apertures are fitted with sleeves 156. Nozzle vanes 300 are supported on trunnions 302 which extend through turbine backwell 130 and sleeves 156. These vanes 300 are positioned circumferentially around the nozzle area and are rotatable to vary flow velocity and angle of exhaust gas to turbine rotor 200. This nozzle area is controlled by control structure 304 positioned between compressor backwall 86 and turbine backwall 130 in an air space gap 320.

Referring to FIG. 2 in conjunction with FIG. 3, nozzle vanes 300 include trunnions 302 which extend through backwall 130 and sleeves 156. Trunnions 302 are attached to activation levers 310. A ball end 312 is formed on one end of each activation lever. These ball ends extend into radial slots 314 formed in a control ring 316. Control ring 316 is concentrically positioned about the axis of shaft 202 and is received on the cylindrical extension 92 formed on compressor backwall 86.

In a preferred embodiment of the invention, control ring 316 includes an inner ring 350 and an outer ring 352 formed with an inner and outer raceway, respectively, for receiving a plurality of balls 354 therebetween. Inner ring 350 is fixedly attached to the cylindrical extension 92. Extending from the compressor backwall, an outer ring 352 rotates angularly relative to the inner ring. Referring to FIG. 3, it can be seen that by rotation of outer ring 352, each of the activation levers 310 is rotated about the axes of trunnions 302, resulting in simultaneous rotation of each nozzle vane 300. As is shown in FIG. 3, one of the activation levers **310*a* includes an extension 360 which is engaged by a block attached to a control rod 362. By movement of control rod 362, activation lever 310*a* is pivoted to accurately rotate outer ring 352 of control ring 316 thereby rotating each of the other activation levers 310 and nozzle vanes 300** attached thereto.

As can be seen in FIGS. 2 and 3, control ring 316 and activation levers 310 are situated in air space gap 320 intermediate of compressor backwall 86 and turbine backwall 130 and therefore intermediate of compressor rotor 204 and turbine rotor 200. Mica sheet insulators 380 and 382, as well as a composite insulator 386 consisting of ceramic felt covered on both sides by stainless steel foil, are also positioned in gap 320.

The present invention incorporates a novel design for the oil reservoir used to provide lubrication to bearing assemblies 220 and 222. The oil reservoir incorporates an oil reservoir cover 400 defining a circumferential reservoir 402 between outer circumferential wall 404 and inner circumferential wall 406 connected by an end wall 408. Wall 406 extends beyond end wall 408 to produce a cylindrical attachment sleeve 410 which is designed to accommodate the requisite diameter air supply hose or ducting as necessary. The inner diameter of wall 406 and sleeve 410 defines an inlet 412 which is in alignment with inlet wall 44 of compressor housing 40.

The end of wall 406 adjacent the compressor housing has an enlarged opening 414 for receiving the inlet port wall therein. A groove 416 is formed within wall 406 and receives an elastomeric O-ring seal 418. As shown in enlarged view in FIG. **2*a*, wall 404 also has an enlarged end defining a circumferential surface 420 and has a shallow groove 422 therein. Surface 420 mates with extension sleeve 58 from compressor housing 40. The circumferential groove 60 formed within extension sleeve 58 receives an elastomeric O-ring seal 430 therein and such O-ring likewise engages groove 422 in the assembled position as shown in FIG. 2**.

In the primary embodiment of the invention, extension sleeve 58 and inlet wall 44 of the compressor housing are positioned radially inside walls 404 and 406 of the reservoir cover 400. In the preferred embodiment, in the install condition prior to heat up, there is a circumferential clearance of 0.005 in. between wall 404 and wall 406, with the seal being formed by O-ring 418. There is a clearance of approximately 0.002 in. between wall 404 and sleeve 58, in the pre-heated condition, with the seal being formed by O-ring 430. Because the compressor housing is positioned radially inside the reservoir cover and because, during operation, it reaches a higher temperature than the reservoir because of its proximity to the turbine side, sleeve 58 and wall 44 expand more than walls 404 and 406 of cover 400 to cause a further sealing effect at this juncture. To further facilitate the transfer of heat from compressor housing 40 to reservoir cover 400, the surfaces of inlet wall 44 and extension sleeve 58 which confront walls on cover 400 have a smooth finish to further facilitate heat transfer.

Circumferential reservoir 402 then communicates with the circumferential chamber 62 defined by compressor housing 40. This combined area makes up the oil reservoir for the turbocharger. Wicks 424 and 426 are positioned through one of the three struts 82 such that one end is in engagement with rotor shaft 202 adjacent ball bearings 264 and 246 with the other end within the reservoir defined by circumferential reservoirs 62 and 402. The wicks may be selectively positioned through any of the three struts to facilitate any desired orientation of the turbocharger.

Orientation of the reservoir cover relative to gravity, is important to the proper operation of a self-lubricating bearing system as in the present design. Thus, the oil reservoir must be oriented such that the wicks are submerged in oil during operation. With the present design, the turbocharger may be oriented in any angular relationship relative to the longitudinal axis of the unit and the wicks positioned in the appropriate strut such that they will be submerged in oil within the reservoir. Changes in orientation are necessitated because the compressor air inlet and outlet ducts and the turbine inlet and outlet flanges will vary from application to application. Thus, the present design can accommodate any orientation for these compressor and turbine requirements.

Thus, the design of the oil reservoir chamber as described achieves several advantages. First, because the oil chamber is circumferential, the turbocharger may be positioned in almost any installation orientation.

Second, the reservoir cover 400 may be easily machined to different lengths to increase or reduce the depth of reservoir 402 thereby altering the effective reservoir capacity of the resultant cavity as needed.

Third, by simply changing the reservoir cover which also accommodates the attachment of the turbocharger to the air supply hose, differing air supply hoses or ducting can be accommodated. For example, reservoir covers having different shapes and sizes at sleeve 410 may be configured to accommodate installation requirements.

Fourth, the use of circular cross-section elastomeric seals such as O-rings 418 and 430 provide a means for retaining the parts in a mating relationship. This arrangement eliminates the need for mechanical fasteners and assures positive retention of the reservoir cover. Tests have shown that axial removal forces in excess 100 kilograms are required to overcome the design's retention strength. Further, there are no visible means of disassembly with this design, hence the product appears to be tamper resistent.

Figure 2A:
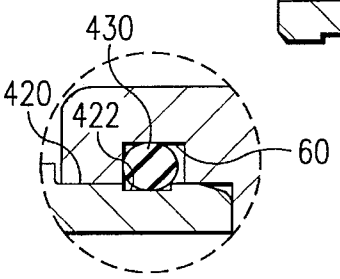
FIG. 2*a* is an enlarged view of the area of engagement between the oil reservoir cover and the compressor housing, designated as 2*a* in FIG. 2.

Referring to FIG. 2*a*, it can be seen that the retention capability provided by the O-rings is enhanced by the use of grooves 60 and 422. During assembly, O-ring 430 is compressed as the end of wall 404 is engaged thereover until the elastomeric O-ring is positioned in both groove 60 and groove 422.

Fifth, the mass about the reservoir cover and the quantity of lubrication oil within the integral reservoir cover, augments that of the compressor housing. Increased mass of the compressor side components benefits the durability of the unit by limiting the thermal stresses to the bearings and oil.

The present turbocharger incorporates several unique techniques to minimize the buildup of heat in the compressor side of the turbocharger after a hot shutdown. While the use of precision miniature ball bearings in turbomachinery has significant advantages, it is imperative that such ball bearings not be exposed to high temperatures that can reduce their operating life. In all turbocharger applications, including those which use an overhung rotor design, substantial transfer of heat to the bearings is inherent due to the proximity of the hot turbine-side to the ball bearings, which are located in the relatively cool, compressor-side.

Heat energy, not unlike force, speed, pressure and other forms of energy, is measured in units, such as calories. Heat-transfer Rate (R) describes the Quantity (Q) of heat energy that is transferred within a certain Time (T). The rate is dependent upon the Conductivity (K) of the transfer medium and the difference between the source-temperature (t2) of the heat energy and the destination-temperature (t1) of the transferred heat. A larger temperature difference ($\Delta t$) between the source and destination of the transferred heat will result in an increased rate R. For a given quantity of heat, transferred at a constant rate over a specified period of time, the resulting temperature-increase of a destination object is directly proportional to the Mass (M) of the object.

Increasing the distance between the source and destination of heat energy will increase the time required for a given quantity to be transferred.

Heat transfer must occur across a medium (solid, liquid or gaseous); therefore decreasing the Area (A) of the media's path-of-transfer will directly reduce the rate R. The flow of heat energy, like the flow of water through a pipe, is affected by the size of the conduit. Small pipe restricts the flow-path of water just as a small area of surface contact will restrict the flow of heat.

Conventional methods have been employed to minimize heat-transfer from the turbine side to the compressor section of the turbocharger by using composite insulators such as composite insulator 386 and mica sheet insulators 380 and 382, shown in FIGS. 2 and 3, and reduced-contact-area interfaces between mating components. While effective, these techniques alone may not be sufficient in every situation to protect the bearings from exposure to excessively high temperatures. Additional measures are necessary to limit the total amount of thermal energy (heat flux) transferred to the compressor.

The specific design of the V-band clamp 34 used in the present invention to connect compressor housing 40 to turbine housing 120 has proven effective in reducing the contact area between the two corresponding flanges and the V-band clamp and therefore reduces the transfer of heat flux from the turbine side to the compressor side. In one embodiment, referring to FIGS. 4 and 5, clamp 34 includes an outer band 500 which is looped at its ends to receive a connecting latch mechanism 502. Latch mechanism 502 includes a T bolt 504 which has its head 506 pivotally secured in one of the looped ends and the threaded shaft 508 positioned through a harness fitting 510 engaged in the loop on the opposite end of band 500. A nut 512 is threaded onto shaft 508 against a spring 514 to allow the band to be tightened and pulled together for engagement with the turbocharger housing.

Figure 6:
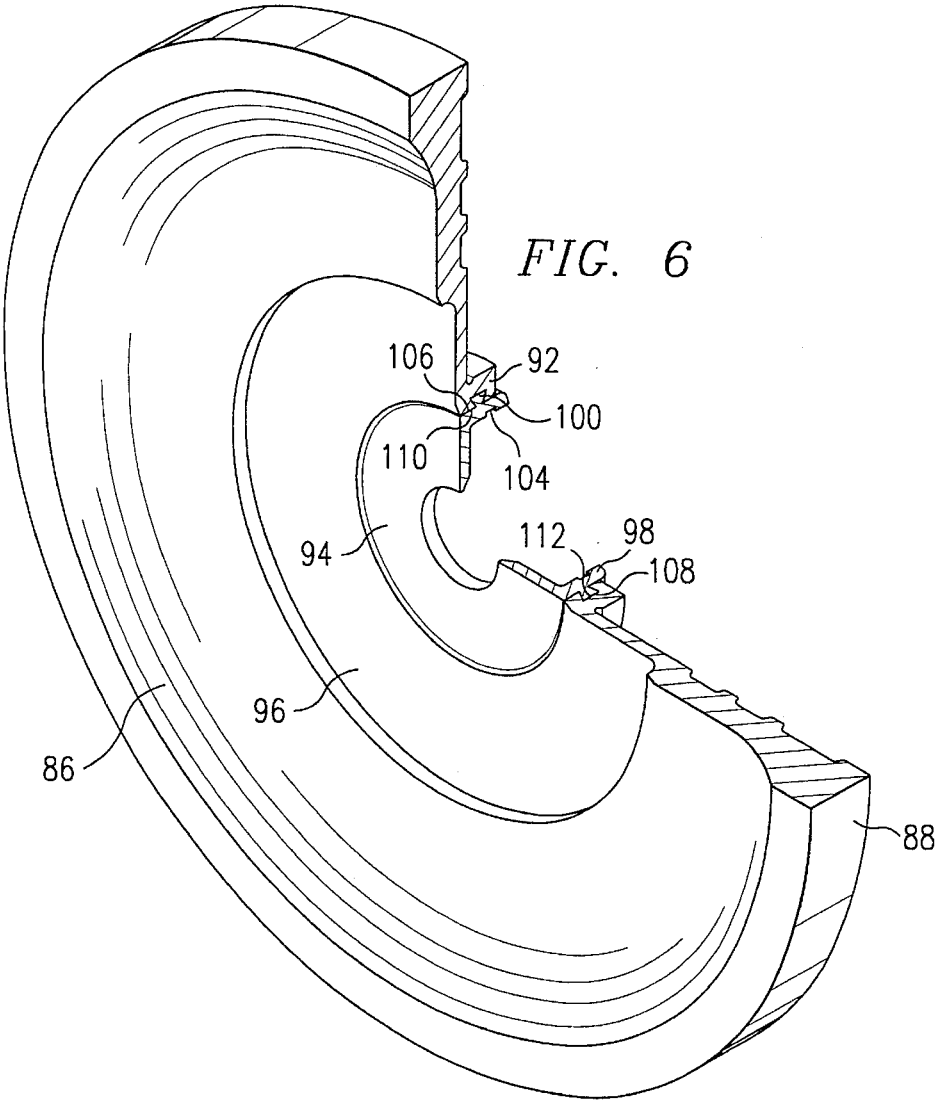
FIG. 6 is a enlarged perspective view with a quarter section removed of the compressor housing backwall and insert.
Figure 4:
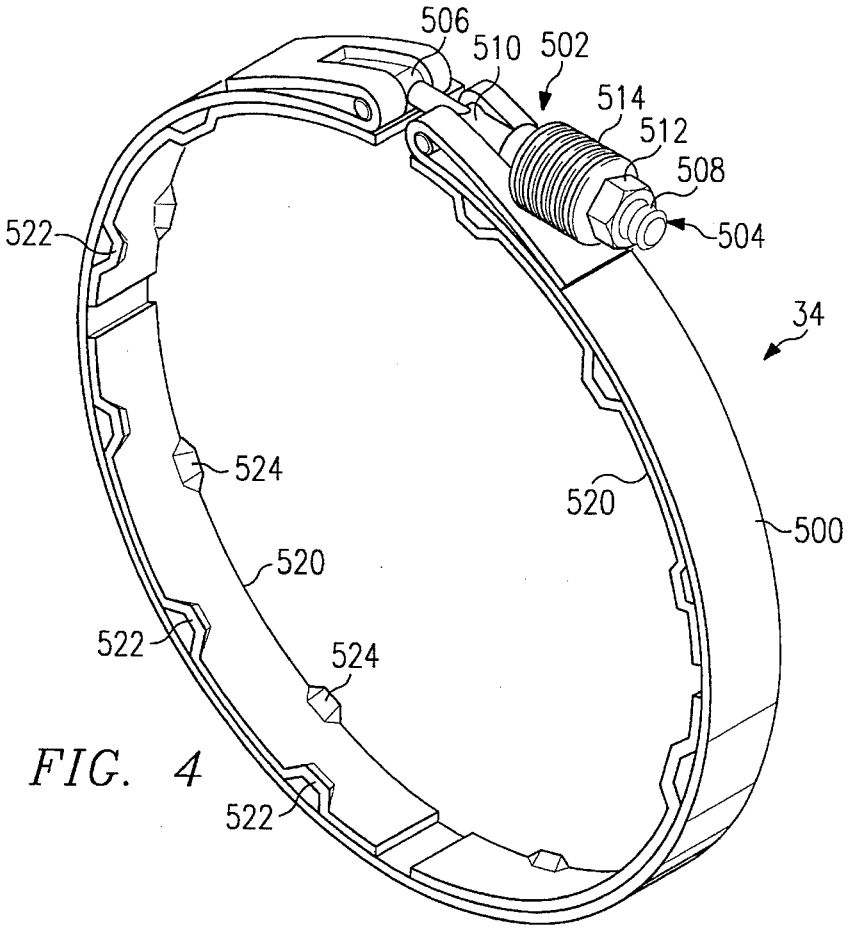
FIG. 4 is an enlarged perspective view of the clamp used to assemble the turbine and compressor housings of the turbocharger in FIG. 1.
Figure 5:
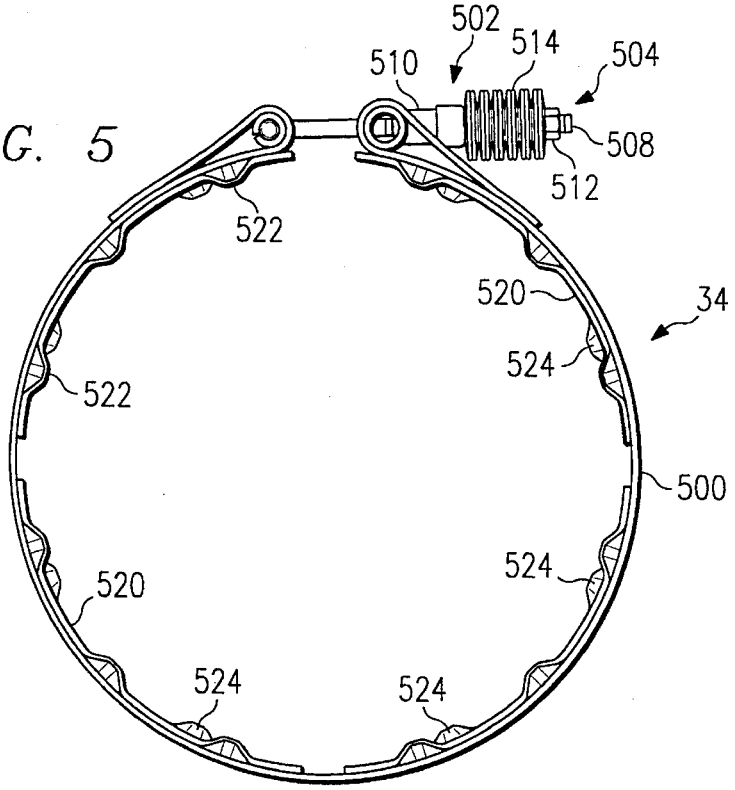
FIG. 5 is a plan view of the clamp of FIG. 4.

In the embodiment shown, a plurality of plates 520 are spot-welded to the inside surface of band 500. Plates 520 have a plurality of inclined pads 522 on the compressor side and pads 524 for engagement on the turbine side. As can be seen in FIGS. 4 and 5, pads 522 are staggered around the circumference of the band in relation to pads 524. As can be seen in FIG. 6, the projection of the area of pads 522 along an axis parallel to the longitudinal axis of the turbocharger does not project onto the area of certain of the pads 524. Because the material of the compressor housing is different from the material of the turbine housing for turbomachinery, the compressive yield strength of each flange varies. The axial clamping force of the clamp is known and thus the number and size of pads can be optimized for use against each material. Additionally, by staggering the pads 522 along the circumference of the clamp from pads 524, the path of heat flux can be lengthened thereby increasing the time required for heat to travel from the turbine side to the compressor side flange. An optimum ratio of turbine side to compressor side pads can be derived which maximizes the heat flux path length, avoids localized stresses near the compressive yield strength of the corresponding flange's material and simultaneously minimizes the total contact area of the clamped flange interfaces.

In one embodiment of the present invention, it has been found that 12 equal area pads may be used on the compressor side to 8 equal area pads on the turbine side, fewer pads being needed on the turbine side because of the higher compressive strength of cast iron alloy as compared to aluminum alloy.

The engagement of clamp 34 to attach the compressor side 22 to the turbine side 28 can be seen in FIG. 2. Compressor housing 40 includes a flange 64 as described hereinabove with an inclined surface 66 thereon. Turbine housing 120 includes a flange 140 with an inclined surface 142 thereon. Pads 522 on clamp 34 engage inclined surface 66 while pads 524 engage inclined surface 142. Because of the angular relationship, as clamp 34 is drawn up, compressor housing 40 is forced axially toward turbine housing 120.

Spring 514 allows for circumferential growth and contraction of clamp 34 to accommodate expansion and contraction resulting from heat up and cool down of the turbocharger components. Thus, as the components expand or contract, compressor housing 40 moves relative to turbine housing 120 causing pads 522 and 524 of clamp 34 to slide along respective inclined surfaces 66 and 142 to allow for such expansion and contraction. Without spring 514, damage to the clamp and/or the flanges of the housings would result or loss of clamping force would occur.

The present invention also reduces the heat transfer from the turbine side to the compressor side by redistribution of the mass at the various components of the turbocharger.

In any hot shutdown situation, a substantial amount of heat energy must be dissipated from the turbine side. Radiant cooling (to the atmosphere) occurs at a maximum theoretical rate determined by ambient conditions, exterior surface area and other factors. A substantial amount of heat is transferred to the compressor side, by conduction and radiation, where it is subsequently dissipated. Where thermal insulation has been optimized to minimize conduction of heat energy between the turbine and compressor side components, further efforts to control the rate of heat transfer have little effect. The thermal flux (amount of heat transferred between components in a given time) is limited by the thermal conductivity of the optimized insulation scheme and is, therefore, predictable.

Because the quantity of heat energy is a given in any hot shutdown scenario, the ability of the turbine housing to store and dissipate that energy is a primary influence on the inevitable transfer of heat to the compressor side. Practical limitations on casting techniques, material cost and other design considerations govern the effective outside surface area that can dissipate heat from the turbine housing to the atmosphere. However, by reducing the total mass of the turbine housing, the present invention minimizes the effective heat content. Reduction in the turbine housing mass is coupled with careful engineering of thin wall sections with highly stressed bosses and flanges to appreciably reduce the capacity of the housing to retain heat after a hot shutdown.

While reducing the turbine side mass reduces the thermal flux, some heat energy can still be transferred to the compressor housing. The present invention further alleviates potential problems which may be caused by such heat transfer by increasing the mass of the compressor housing casting and its subcomponents thereby minimizing the resulting temperature increase from the flux of turbine-side heat energy. The present invention accomplishes this overall turbine side mass reduction and compressor side mass augmentation such that the mass ratio of the turbine side to the compressor side is equal to or less than 2.0. The mass ratio is calculated by including the oil reservoir cover as a part of the compressor side mass but not including the components associated with the nozzle vanes 300 or the control structure in gap 320 as part of the mass ratio calculation.

The compressor side augmentation in the present invention includes the effective mass of the oil reservoir cover 400. Further, the location, geometry and surface finish of certain axial and radial mating surfaces, on both the oil reservoir cover 400 and the compressor housing 40, assure that effective contact is maintained throughout the heat-soak cycle. These contact surfaces include the wall contacts between sleeve 58 of compressor housing 40 and wall 404 of the oil reservoir cover 400. As can also be seen in FIG. 2, the distal end of wall 404 is positioned in abutting relationship with compressor housing 40.

This deliberate control of the heat flux path enhances dissipation of excess heat energy, further protecting the precision miniature bearings 246 and 264. The elastomeric seals 418 and 430 between the reservoir housing and compressor housing are also shielded from exposure to temperature extremes as the heat flux is maneuvered away from the sealing surface and into the metal components.

Further, the use of the circumferential oil reservoir chamber permits the incorporation of a larger quantity of synthetic lubricant therein which contributes to the total mass of the compressor section, further enhancing the heat absorption capacity. This lubricant is in contact with surfaces of both the compressor housing and the reservoir housing. Thus, heat transfer between the respective components is improved. Localized variances in surface temperatures are likewise reduced.

Figure 7:
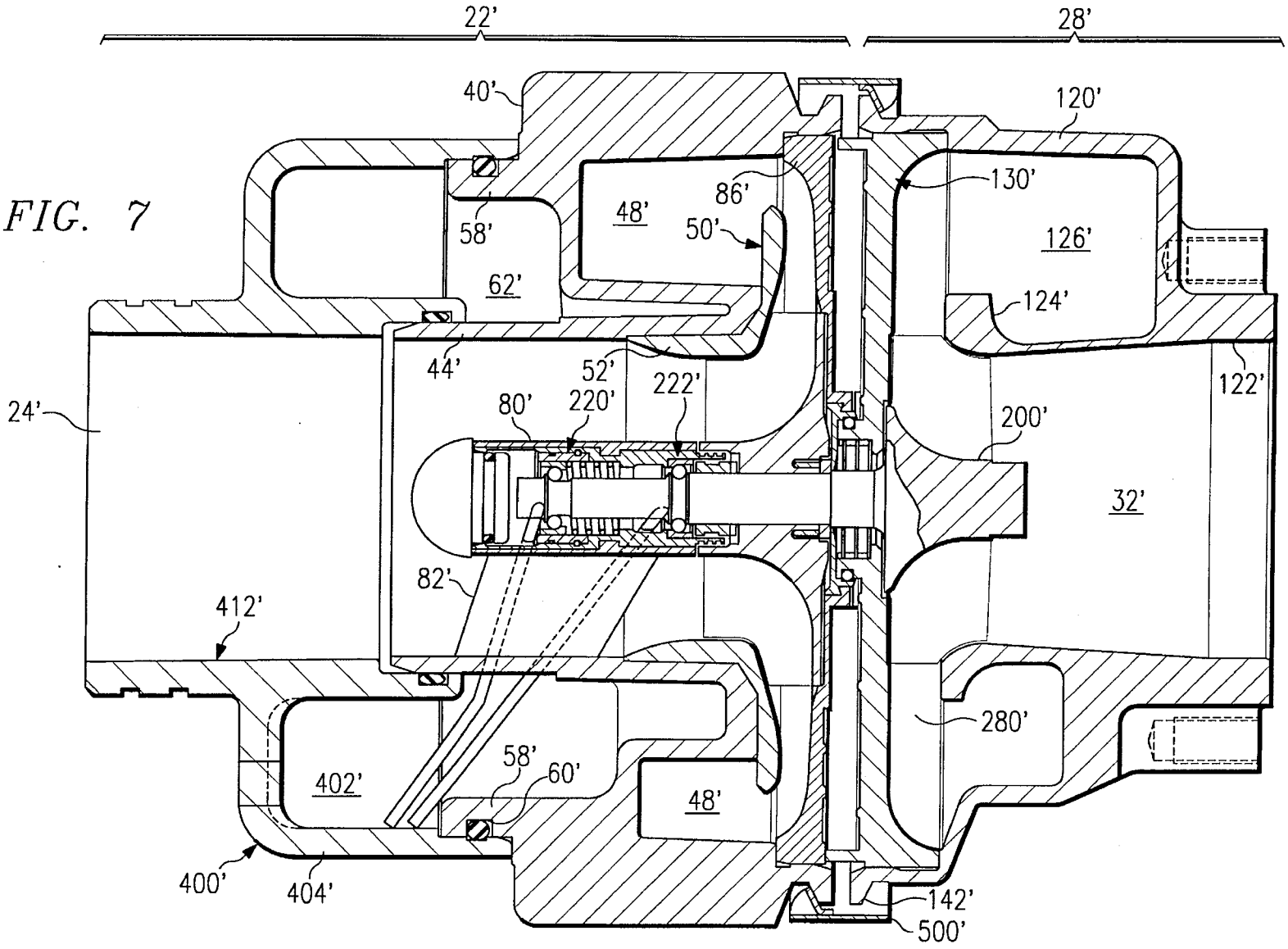
FIG. 7 is a vertical section of a turbocharger having a fixed turbine inlet area and incorporating the inventive features described with respect to FIGS. 1 through 3.

FIG. 7 shows a turbocharger having a fixed turbine inlet area and therefore without the corresponding nozzle control structure found in the turbocharger of FIGS. 1 through 3.

However, the turbocharger incorporates all the inventive features of heat transfer reduction and concentricity control between the compressor and turbine housings. The turbocharger shown in FIG. 7 need not be described in complete detail because of the corresponding structure between this embodiment and that shown in FIGS. 1 through 3. The components of the turbocharger of FIG. 7 which correspond to those in the embodiment of FIGS. 1 through 3 have been assigned numbers that correspond to those used in describing the embodiment of FIGS. 1 through 3 but with the addition of the designation prime (′). It will be noticed that the turbine housing 120′ has substantially less mass than turbine housing 120 of the first embodiment. Further, there is no variable geometry control structure positioned between compressor backwall 86′ and turbine backwall 130′ and no inlet vanes 300 within the inlet area 280′ of turbine inlet 120′. However, the remaining components substantially correspond to components in the embodiment of FIGS. 1 through 3. In this embodiment, just as in the embodiment of FIGS. 1 through 3, the mass ratio of the turbine side to the compressor side is equal to or less than 2.0.

Although the present invention has been described with respect to a preferred embodiment, various changes, substitutions and modifications of this invention may be suggested to one skilled in the art, and it is intended that the present invention encompass such changes, substitutions and modifications as fall within the scope of the appended claims.

We claim:

1. Turbomachinery comprising:

a turbine and compressor rotor mounted on a shaft, a turbine housing for housing the turbine rotor and having a backwall positioned between the turbine rotor and the compressor rotor, said backwall being formed from a first metal, a compressor housing for housing the compressor rotor and having a backwall between the turbine rotor and compressor rotor, said compressor backwall being formed from a second metal different from the first metal, and a metal insert made from a metal having like thermal properties with those of the first metal, said insert integral with the compressor backwall and being positioned for engagement with the turbine backwall for aligning the turbine housing relative to the compressor housing, said insert having a coefficient of thermal expansion equal to or greater than the average of the coefficients of thermal expansion of the compressor and turbine backwalls.

2. Turbomachinery comprising:

a turbine and compressor rotor mounted on a shaft, a turbine housing for housing the turbine rotor and having a backwall positioned between the turbine rotor and the compressor rotor, said backwall being formed from a first metal, a compressor housing for housing the compressor rotor and having a backwall between the turbine rotor and compressor rotor, said compressor backwall being formed from a second medal different from the first metal, and a metal insert made from a metal having like thermal properties with those of the first metal, said insert integral with the compressor backwall and being positioned for engagement with the turbine backwall for aligning the turbine housing relative to the compressor housing, said insert having a coefficient of thermal conductivity less than the coefficient of thermal conductivity of both the compressor and turbine backwalls.

3. Turbomachinery comprising:

a turbine housing having a backwall formed from a first material, a compressor housing having a backwall formed from a second material different from the first material, said backwall confronting the backwall of the turbine housing, and an insert made from a material of like properties of the first material, said insert being formed into the compressor backwall and being positioned for engagement with the turbine backwall for aligning the turbine housing relative to the compressor housing, wherein said insert has a coefficient of thermal expansion equal to or greater than the average of the coefficients of thermal expansion of the compressor and turbine backwalls.

4. Turbomachinery comprising:

a turbine housing having a backwall formed from a first material, a compressor housing having a backwall formed from a second material different from the first material, said backwall confronting the backwall of the turbine housing, and an insert made from a material of like properties of the first material, said insert being formed into the compressor backwall and being positioned for engagement with the turbine backwall for aligning the turbine housing relative to the compressor housing, wherein said insert has a coefficient of thermal conductivity less than the coefficient of thermal conductivity of both the compressor and turbine backwalls.

5. Turbomachinery comprising:

a turbine rotor and compressor rotor mounted on a shaft, a turbine housing for housing the turbine rotor and having a backwall positioned between the turbine rotor and the compressor rotor, said backwall being formed from a first material, a compressor housing for housing the compressor rotor and having a backwall between the turbine rotor and compressor rotor, said housing being formed from a second material, and an insert made from a material of like properties of the first material, said insert being attached to the compressor backwall and being positioned for engagement with the turbine backwall for aligning the turbine housing relative to the compressor housing, wherein said insert has a coefficient of thermal expansion equal to or greater than the average of the coefficients of thermal expansion of the compressor and turbine backwalls.

6. Turbomachinery comprising:

a turbine rotor and compressor rotor mounted on a shaft, a turbine housing for housing the turbine rotor and having a backwall positioned between the turbine rotor and the compressor rotor, said backwall being formed from a first material, a compressor housing for housing the compressor rotor and having a backwall between the turbine rotor and compressor rotor, said housing being formed from a second material, and an insert made from a material of like properties of the first material, said insert being attached to the compressor backwall and being positioned for engagement with the turbine backwall for aligning the turbine housing relative to the compressor housing, wherein said insert has a coefficient of thermal conductivity equal to or greater than the coefficient of thermal conductivity of both the compressor and turbine backwalls.

* * * * *